US008564182B2

(12) United States Patent
Boehme et al.

(10) Patent No.: US 8,564,182 B2
(45) Date of Patent: Oct. 22, 2013

(54) LAMP HAVING CONTACT MEMBERS AT ITS SURROUNDING EDGE, AND A LAMP HOLDER

(75) Inventors: Oliver Boehme, Aachen (DE); Peter Meier-Graichen, Aachen (DE); Markus Gollan, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 469 days.

(21) Appl. No.: 12/678,524

(22) PCT Filed: Sep. 16, 2008

(86) PCT No.: PCT/IB2008/053737

§ 371 (c)(1), (2), (4) Date: Jun. 29, 2010

(87) PCT Pub. No.: WO2009/037630

PCT Pub. Date: Mar. 26, 2009

(65) Prior Publication Data

US 2010/0283372 A1 Nov. 11, 2010

(30) Foreign Application Priority Data

Sep. 21, 2007 (EP) ..... 07116891

(51) Int. Cl.

| | |
|---|---|
| ***H01J 5/16*** | (2006.01) |
| ***H01J 61/40*** | (2006.01) |
| ***H01K 1/26*** | (2006.01) |
| ***H01K 1/30*** | (2006.01) |

(52) U.S. Cl.
USPC ..... 313/113; 313/281; 313/318.12; 362/364

(58) Field of Classification Search
USPC ..... 362/555, 800, 364–366, 612, 545, 362/249.02, 311.02; 313/234, 237, 281, 313/292, 312, 318.01, 318.12, 113
See application file for complete search history.

(56) References Cited

U.S. PATENT DOCUMENTS

| | | | | |
|---|---|---|---|---|
| 5,909,955 | A | 6/1999 | Roorda | |
| 6,491,413 | B1 | 12/2002 | Benesohn | |
| 7,025,477 | B2 | 4/2006 | Blessing et al. | |
| 7,182,502 | B2 | 2/2007 | Petersen | |
| 7,703,951 | B2 * | 4/2010 | Piepgras et al. | 362/373 |
| 2002/0117954 | A1 | 8/2002 | Nagano et al. | |
| 2004/0095763 | A1 * | 5/2004 | Guerrieri et al. | 362/240 |
| 2009/0167189 | A1 * | 7/2009 | Wu et al. | 315/112 |

FOREIGN PATENT DOCUMENTS

| | | | |
|---|---|---|---|
| CA | 2213014 | B2 | 9/1996 |
| DE | 19511042 | A1 | 9/1996 |
| DE | 202006002583 | U1 | 6/2007 |
| WO | 2008018000 | A1 | 2/2008 |

* cited by examiner

*Primary Examiner* — Anne Hines
*Assistant Examiner* — Jose M Diaz

(57) ABSTRACT

A lamp comprising electric contact members (9,10) at the outside of the lamp for making contact with corresponding electric contact elements (21,22) in a lamp holder surrounding the lamp. The light radiation of the lamp is emitted from the front side (2) of the lamp, which front side (2) is substantially located in a plane perpendicular to the longitudinal direction of the lamp. The contact members (9,10) are located near the circumferential edge of said front side of the lamp.

12 Claims, 3 Drawing Sheets

LAMP HAVING CONTACT MEMBERS AT ITS SURROUNDING EDGE, AND A LAMP HOLDER

FIELD OF THE INVENTION

The invention is related to a lamp comprising electric contact members at the outside of the lamp for making contact with corresponding electric contact elements in a lamp holder, the light radiation of the lamp being emitted from the front side of the lamp, said front side being substantially located in a plane perpendicular to the longitudinal direction of the lamp.

BACKGROUND OF THE INVENTION

Most conventional lamps comprise a base part being provided with means for fixing the lamp in the lamp holder. Furthermore, the base part of the lamp carries the electric contact members for supplying electric power to the burner of the lamp, and the lamp holder comprises corresponding electric contact elements. The electric contact members and the electric contact elements can be incorporated in the means for fixing the lamp in its lamp holder.

For many applications of the lamp, the total dimension of the assembly of lamp and lamp holder in the longitudinal direction, hereinafter also indicated as length of the lamp, has to be relatively small. For example, a small length of the lamp and lamp holder is an advantage in case the lamp holder is mounted in a ceiling or in furniture like a cupboard, where the lamp is located against or in the lower side of a shelf. But also in a luminaire a relatively small longitudinal dimension of the lamp and/or the assembly of lamp and lamp holder can be an advantage.

The lamp may comprise an incandescent burner, or a halogen burner, or a number of LEDs (light emitting diodes), or a tube-like low pressure gas discharge burner, or any other kind of burner. The lamp furthermore may be provided with electronic circuit means for controlling the light source of the burner. In case the lamp has to have a relatively small dimension, in particular a small dimension in the longitudinal direction, an efficient location of the different components and parts inside the lamp is desired.

SUMMARY OF THE INVENTION

An object of the invention is a lamp and/or a lamp holder having a relatively small longitudinal dimension.

Another object of the invention is a lamp comprising a burner and electronic control means, whereby the lamp is provided with a compact structure.

In order to comply with one or both of these objects, the contact members of the lamp are located near the circumferential edge of the front side of the lamp. Preferably, the contact members border the edge of the front side of the lamp. Thereby, all the space behind the front side of the lamp—up to the back side of the lamp—can be used for other parts of the lamp, such as the reflector of the lamp, the burner, and electronic control means.

In a preferred embodiment, the lamp comprises a reflector for reflecting the light radiation through the front side of the lamp, the dimension of the reflector in the longitudinal direction being substantially equal to the length of the lamp. Thereby, the whole length of the lamp can be used for accommodating a relatively large reflector, while the dimension of the lamp in the longitudinal direction remains relatively small.

The shape of the lamp, seen from its front side, may be rectangular or square, but in a preferred embodiment, said shape of the lamp, i.e. the shape of the edge of the front side of the lamp, is circular. For example, when the lamp and lamp holder is mounted in a recessed part of the lower side of a shelf, the lamp can be accommodated in a circular recession that can be made in a simple material-removing operation.

Preferably, in all directions in its plane, the front side of the lamp is at least three times larger, preferably five times larger than the largest longitudinal dimension of the lamp. Furthermore, preferably, the longitudinal dimension of the lamp is less than 25 mm, more preferably less than 15 mm. Such dimensions of the lamp enable a wide range of applications of the lamp; for example, the lamp can be located in a recessed surface or in a luminaire having a small longitudinal dimension.

The burner of the lamp can be a tube-like discharge burner, for example zigzag curved, but in another preferred embodiment, the lamp comprises a halogen burner or the lamp comprises a number of LEDs (light emitting diodes). The lamp may comprise a relatively large reflector, and the electronic means for controlling the functioning of the burner can be located around the reflector, i.e. between the back side of the reflector and the circumferential outer surface of the lamp.

In a preferred embodiment, the contact members of the lamp are located at opposite sides of the lamp, with, preferably, at least a part of each contact member being resilient in order to engage with a corresponding part of the corresponding contact element of a lamp holder, so that the lamp can be fixed in the lamp holder by clamping contact between the contact members and the contact elements. The contact members and/or the contact elements can be resilient.

The invention is also related to a lamp holder for a lamp as described above, comprising electric contact elements for making conductive contact with corresponding electric contact members of the lamp, the lamp holder comprising a wall parallel to the longitudinal direction of the lamp holder, so that the lamp holder can completely surround a lamp, and the electric contact elements being located at the inner side of said wall of the lamp holder. The lamp can be inserted into the lamp holder through the open front side of the lamp holder. The lamp holder may have a back wall, but preferably a major part of the back side of the lamp holder is open, so that the lamp can be accommodated in the space inside the lamp holder extending up to the back side of the lamp holder, the length of the assembly of lamp and lamp holder being equal to the length of the lamp itself. As a result, the lamp assembly is compact, such that the assembly of lamp and lamp holder need not be longer than the length of the reflector in the lamp.

Furthermore, the lamp holder comprises means for fixing the lamp holder, which means are preferably fixation members extending inwardly from the edge of said wall at the back side of the lamp holder. Preferably, each fixation member comprises a bore, so that the lamp holder can be fixed by means of screws passing through these bores, for example against the lower side of a shelf or in a recess in the lower side of a shelf.

In a preferred embodiment of the invention, the longitudinal dimension (length) of the lamp holder is substantially equal to the longitudinal dimension of the lamp. The length of the assembly of lamp and lamp holder is equal to the length of each of the individual lamp and lamp holder. This has the advantage that the outer wall surface of the lamp holder can be used as a reference for other components of the luminaire comprising the lamp assembly.

BRIEF DESCRIPTION OF THE DRAWINGS

The invention will now be further elucidated by means of a description of a first embodiment (FIGS. 1-5) and a second embodiment (FIG. 6) of the lamp and its lamp holder according to the invention, with reference being made to the drawing comprising diagrammatical figures, wherein.

The figures show only parts of the lamp and lamp holder that are relevant for the elucidation of the invention.

DETAILED DESCRIPTION OF EMBODIMENTS

Figure 1:
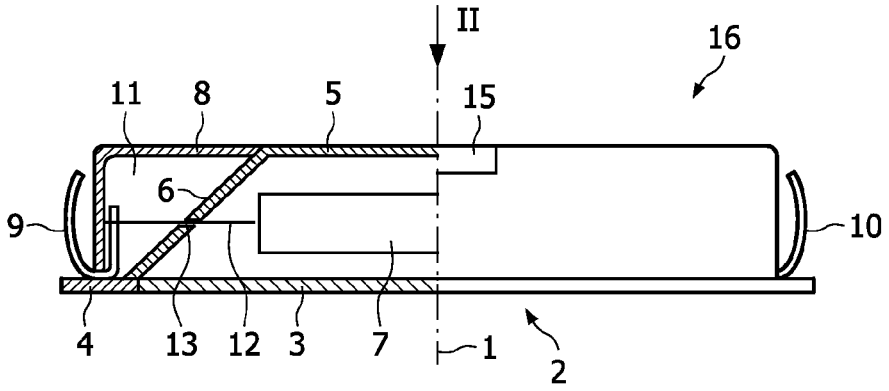
FIG. 1 is a sectional view of the lamp taken along the line I-I in FIG. 2.

On the left side of the line 1 of symmetry in FIG. 1, a lamp 16 is shown in a sectional view, and on the right side the lamp is shown in a side view. The lower side 2 is the front side of the lamp through which the light radiation leaves the lamp. The flat front side 2 of the lamp is formed by a circular transparent wall 3 surrounded by an annular opaque wall 4. Both walls 3,4 are connected to each other and form together the front wall 3,4 of the lamp.

The lamp is to be inserted along the line of symmetry 1 into a lamp holder 19, the line of symmetry thus forming a system axis.

The reflector of the lamp has a flat back wall 5 and a conical side wall 6, which side wall 6 is connected with the annular opaque wall 4 of the front side of the lamp. The inner side of the reflector 5,6 (the lower side in FIG. 1) is provided with a light reflecting coating. A burner 7, for example a low pressure gas discharge lamp, is present between the reflector 5,6 and the front wall 3,4 of the lamp, so that a part of the light radiation from the burner 7 can leave the lamp directly through the transparent wall 3, while another part of the light radiation can pass through said transparent wall 3 after it is reflected by the reflector 5,6. The conical wall 6 of the reflector is surrounded by an annular house part 8 of the lamp, which house part 8 is attached to the reflector 5,6 and to the annular opaque wall 4 of the lamp.

Two strip-like metal electric contact members 9,10 are fixed between the house part 8 and the annular wall 4, so that the outer end of each contact member 9,10 extends outside the lamp and the inner end extends in the space 11 between the house part 8 and the conical wall 6 of the reflector. The inner end of contact member 9 is connected with one end of the power supply wire 12, while the other end of the power supply wire 12 is connected with one of the electrodes of the burner 7. Said wire 12 passes through an opening 13 in the conical wall 6 of the reflector. Contact member 10 is connected with the other electrode at the other end of the burner 7 in the same way (not shown in the figure).

The house part 8 and the reflector 5,6 are made of electrically insulating material, such as plastic, and can be made in one piece, or can be glued or welded together. The same applies for the walls 3,4 at the front side of the lamp and for the connection between the annular wall 4 and the house part 8.

Figure 2:
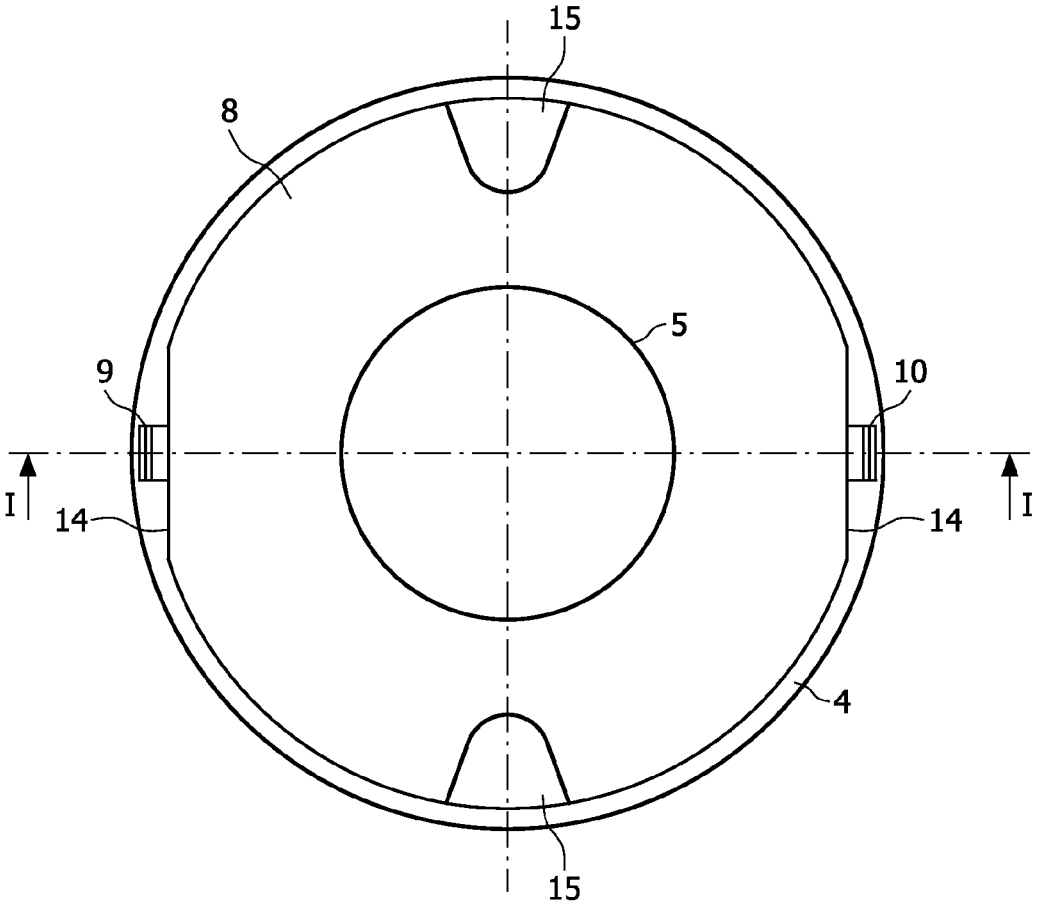
FIG. 2 is a view of the lamp according to the arrow II in FIG. 1.

FIG. 2 shows the back side of the lamp represented in FIG. 1. The annular house part 8 has a substantially cylindrical wall comprising two flat portions 14 at opposite sides. The contact members 9,10 are located at the central part of these flat portions 14. Furthermore, the annular house part 8 comprises two recessed portions 15 for accommodating the fastening means of a lamp holder, as will be elucidated hereinafter.

Figure 3:
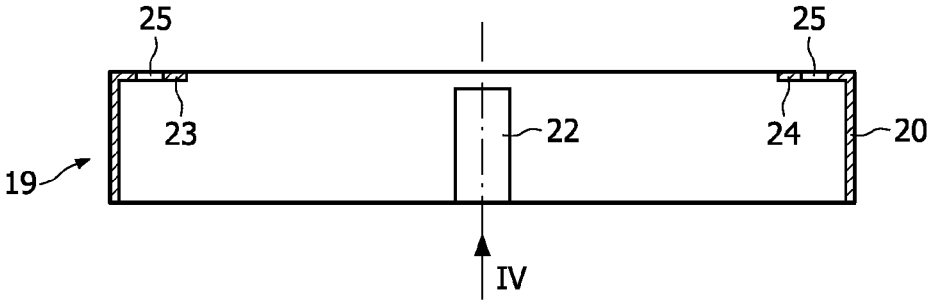
FIG. 3 is a sectional view of the lamp holder taken along the line III-III in FIG. 4.
Figure 4:
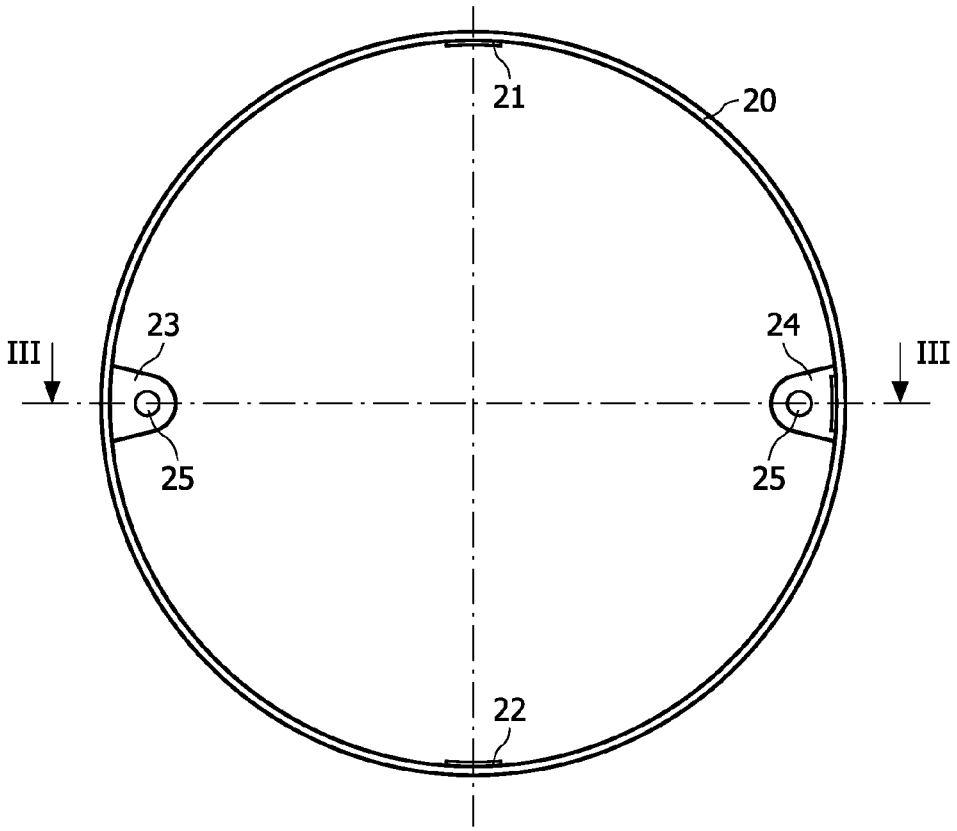
FIG. 4 is a view of the lamp holder according to arrow IV-IV in FIG. 3.

FIGS. 3 and 4 show the lamp holder for the described embodiment of the lamp. The major part of the lamp holder is a cylindrical wall 20. The inner side of the cylindrical wall 20 is provided with two metal electric contact elements 21,22 at opposite locations of wall 20. The two contact members 21,22 are connected by means of conductive wires with means for supplying electric power. The wires and said means are not shown in the figures.

Furthermore, the lamp holder comprises means for fixing the lamp holder, which means are two fixation members 23,24 extending inwardly from one edge of cylindrical wall 20 and being positioned parallel to the plane of FIG. 4. Each fixation member 23,24 is provided with a bore 25, so that the lamp holder can be fixed, for example to the lower side of a shelf, by means of fastening screws passing through these bores 25.

Figure 5:
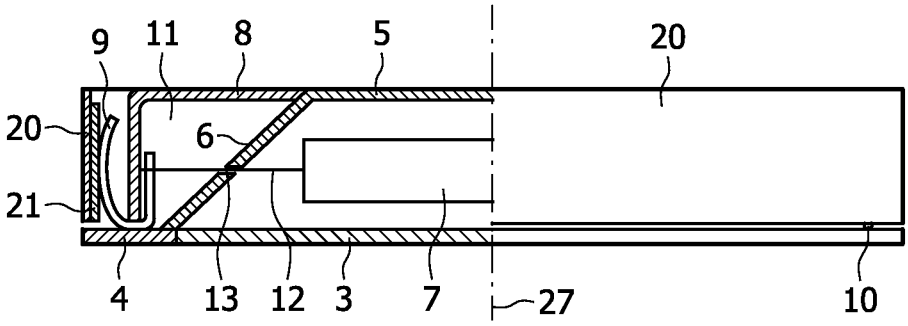
FIG. 5 shows the assembled lamp and lamp holder.

FIG. 5 shows the lamp described with respect to FIG. 1 in the lamp holder described with respect to FIG. 3. As shown in the figure, the contact members 9,10 of the lamp are pressed inwardly by the contact elements 21,22 of the lamp holder. In FIG. 5 only contact member 9 and contact element 21 is visible in the sectional view on the left side of central line 27. On the right side of central line 27 a side view is represented in FIG. 5. The lamp and the lamp holder are fixed to each other by the clamping force between the contact members 9,10 and the contact elements 21,22. The lamp and/or the lamp holder can be provided with additional means for ensuring a correct rotational position of the lamp with respect to the lamp holder, where each contact member 9,10 of the lamp is in contact with the corresponding contact element 21,22 of the lamp holder.

Figure 6:
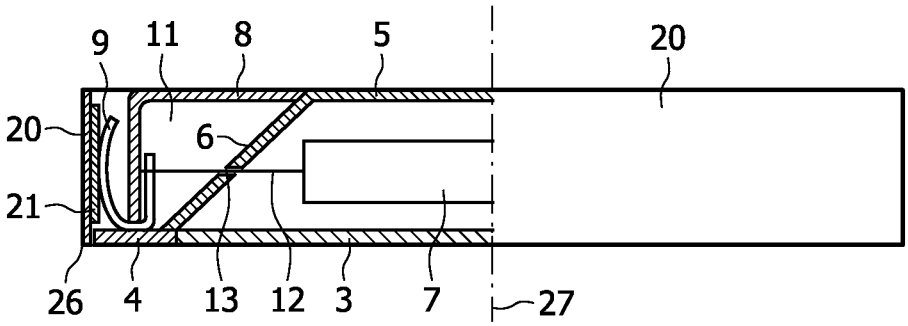
FIG. 6 shows the second embodiment of the lamp and lamp holder.

FIG. 6 shows a second embodiment of the lamp and the lamp holder, represented in the same view as the first embodiment in FIG. 5. In the second embodiment, the annular wall 4 of the lamp has a smaller outer diameter than that shown in the FIGS. 1, 2 and 5, while the longitudinal dimension (i.e. the dimension of the lamp holder transverse to the system axis, hence the dimension in radical direction) of the cylindrical wall 20 of the lamp holder is larger than that shown in FIGS. 3 and 5. The lamp can be fully inserted into the lamp holder in such a way that the front wall 3,4 of the lamp is surrounded by the edge 26 of the cylindrical wall 20 of the lamp holder.

The shown embodiment of the lamp and lamp holder is only an example according to the invention, and many other embodiments are possible according to the invention.

The invention claimed is:

1. A lamp comprising:

electric contact members at the outside of the lamp for making contact with corresponding electric contact elements in a lamp holder, a front side of the lamp from which light radiation of the lamp is emitted, a back side of the lamp comprising a reflector for reflecting the light radiation through the front side, wherein the contact members of the lamp are located near the circumferential edge of said front side of the lamp such that the contact members are located closer to the front side than to the back side of the lamp.

2. A lamp as claimed in claim 1, wherein the dimension of the reflector in the longitudinal direction is substantially equal to the dimension of the lamp in the longitudinal direction.

3. A lamp as claimed in claim 1, in that wherein the shape of the edge of the front side of the lamp is circular.

4. A lamp as claimed in claim 1, wherein, in all directions in its plane, the front side of the lamp is at least three times larger than the largest longitudinal dimension of the lamp.

5. A lamp as claimed in claim 1, wherein the longitudinal dimension of the lamp is less than 25 mm.

6. A lamp as claimed in claim 1, wherein the lamp comprises a halogen burner.

7. A lamp as claimed in claim 1, wherein the lamp comprises a plurality of LEDs.

8. A lamp as claimed in claim 1, wherein the contact members of the lamp are located at opposite sides of the lamp.

9. A lamp as claimed in claim 1, wherein at least a part of each contact member is resilient in order to engage with a corresponding part of the corresponding contact element of a lamp holder, so that the lamp can be fixed in the lamp holder by clamping.

10. A lamp holder for a lamp as claimed in claim 1, comprising electric contact elements for making contact with corresponding electric contact members of the lamp, the lamp holder further comprising a wall parallel to the longitudinal direction of the lamp holder, wherein the lamp holder surrounds the lamp, and the electric contact elements are located at the inner side of said wall; and, wherein the lamp holder is provided with fixation members extending inwardly from the edge of said wall at the back side of the lamp holder.

11. A lamp comprising electric contact members at the outside of the lamp for making contact with corresponding electric contact elements in a lamp holder, the light radiation of the lamp being emitted from the front side of the lamp, wherein the contact members are located near the circumferential edge of said front side of the lamp and a lamp holder as claimed in claim 10 wherein the longitudinal dimension of the lamp holder is substantially equal to the longitudinal dimension of the lamp.

12. A lamp as claimed in claim 1, wherein, in all directions in its plane, the front side of the lamp is at least five times larger than the largest longitudinal dimension of the lamp.

* * * * *